US007011347B2

(12) United States Patent
Finardi

(10) Patent No.: US 7,011,347 B2
(45) Date of Patent: Mar. 14, 2006

(54) LATCH FOR SECTION DOORS AND THE LIKE, AND OPERATING SETS INCLUDING SAID LATCH

(76) Inventor: Ivo Finardi, Viale Sempione 21/31, Arese (Milano) (IT) I-20020

( * ) Notice: Subject to any disclaimer, the term of this patent is extended or adjusted under 35 U.S.C. 154(b) by 89 days.

(21) Appl. No.: 10/658,534

(22) Filed: Sep. 10, 2003

(65) Prior Publication Data

US 2005/0017516 A1 Jan. 27, 2005

(30) Foreign Application Priority Data

Sep. 24, 2002 (IT) ..... TO2002A0083

(51) Int. Cl.
*E05C 1/12* (2006.01)

(52) U.S. Cl. ..... 292/171; 292/28; 292/38; 292/50; 292/125; 292/133; 292/141; 292/DIG. 32; 292/DIG. 36; 292/225; 49/449; 49/450; 160/201

(58) Field of Classification Search ..... 292/171, 292/28, 38, 50, 125, 133, 141, 225, DIG. 36, 292/DIG. 32, 167, 168; 49/449, 450; 160/201, 160/207, 213
See application file for complete search history.

(56) References Cited

U.S. PATENT DOCUMENTS

| | | | | | |
|---|---|---|---|---|---|
| 1,804,329 | A | * | 5/1931 | Farr | 160/190 |
| 1,858,804 | A | * | 5/1932 | Carlson | 292/36 |
| 1,880,850 | A | * | 10/1932 | Dautrick | 70/282 |
| 1,949,805 | A | * | 3/1934 | McGary et al. | 16/96 R |
| 2,039,296 | A | * | 5/1936 | Collins | 160/191 |
| 2,048,377 | A | * | 7/1936 | Robinson | 70/100 |
| 2,124,969 | A | * | 7/1938 | Bagley et al. | 160/209 |
| 2,124,970 | A | * | 7/1938 | Bagley | 292/40 |
| 2,375,837 | A | * | 5/1945 | Buehner | 160/209 |
| 2,580,584 | A | * | 1/1952 | Nowak | 292/36 |
| 3,000,203 | A | | 9/1961 | Olsen et al. | |
| 3,159,205 | A | * | 12/1964 | Varacalli | 160/209 |
| 3,163,033 | A | * | 12/1964 | Boyles | 70/100 |
| 3,177,022 | A | * | 4/1965 | McKee et al. | 292/50 |
| 3,543,441 | A | * | 12/1970 | La Porte | 49/450 |
| 3,683,652 | A | | 8/1972 | Halopoff et al. | |
| 3,788,678 | A | * | 1/1974 | Switzgable | 292/7 |
| 4,080,757 | A | | 3/1978 | Westerman | |
| 4,119,133 | A | * | 10/1978 | Wolf | 160/209 |
| 4,739,584 | A | * | 4/1988 | Zellman | 49/199 |
| 4,880,046 | A | * | 11/1989 | Gesy | 160/194 |

(Continued)

FOREIGN PATENT DOCUMENTS

DE 3248498 A1 7/1984

(Continued)

*Primary Examiner*—Brian E. Glessner
*Assistant Examiner*—Carlos Lugo
(74) *Attorney, Agent, or Firm*—Young & Thompson

(57) ABSTRACT

A latch for a section door wherein near the hinges located between the door elements there are provided, at each end of the elements, small rolling wheels which turn on horizontal pivots and slide within side guide bars having a vertical branch, an upper horizontal branch, and a curved connection branch located between the vertical and horizontal branches; the latch is located sideways and is intended for engaging, in its active position, in an opening provided in one of the side guide bars. The side latch is located coaxially with one of the small wheels intended to slide within the side guide bars of the section door. Preferably, the small wheel coaxial to the latch is mounted on a hollow pivot, and the latch is guided to slide within the bore of this hollow pivot.

16 Claims, 8 Drawing Sheets

U.S. PATENT DOCUMENTS

| | | | | | |
|---|---|---|---|---|---|
| 5,001,861 | A * | 3/1991 | Hahn | 49/280 |
| 5,448,855 | A * | 9/1995 | Sjoholm | 49/125 |
| 5,489,130 | A * | 2/1996 | Clark | 292/66 |
| 5,495,640 | A * | 3/1996 | Mullet et al. | 16/97 |
| 6,006,560 | A * | 12/1999 | DeVries | 70/208 |
| 6,086,121 | A * | 7/2000 | Buckland | 292/34 |
| 6,112,799 | A * | 9/2000 | Mullet et al. | 160/201 |
| 6,463,988 | B1 * | 10/2002 | Mullet et al. | 160/201 |
| 6,485,068 | B1 * | 11/2002 | Sauve | 292/171 |
| 6,601,884 | B1 * | 8/2003 | Bastian | 292/222 |
| 6,672,009 | B1 * | 1/2004 | Wong et al. | 49/183 |

FOREIGN PATENT DOCUMENTS

| | | |
|---|---|---|
| DE | 85 29 024 U | 3/1987 |
| EP | 1 041 230 A2 | 10/2000 |
| WO | WO 98/10165 | 3/1998 |

* cited by examiner

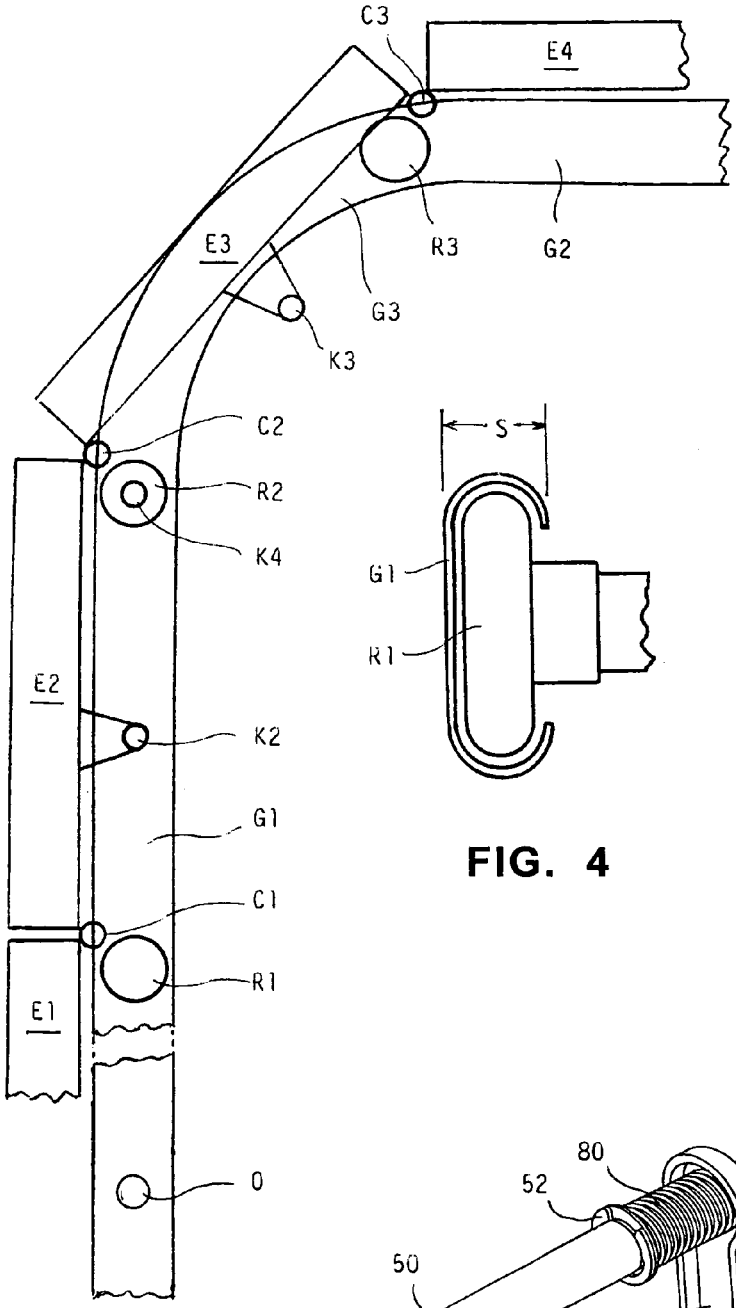
FIG. 3
FIG. 4
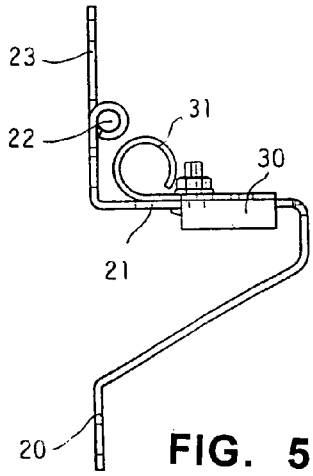
FIG. 5
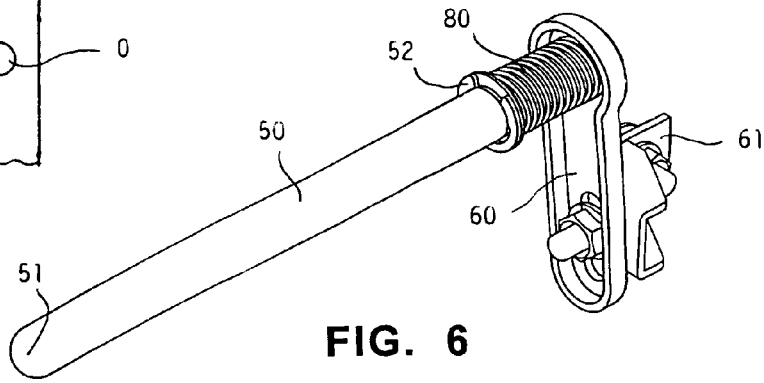
FIG. 6

LATCH FOR SECTION DOORS AND THE LIKE, AND OPERATING SETS INCLUDING SAID LATCH

BACKGROUND OF THE INVENTION

The subject of the present invention is a latch, mainly intended for the closure of a section door or the like. The invention also concerns some operating sets and an assembly, including said latch.

The section doors are used mainly in the garages and the like, and they are formed by a number of sections in the shape of horizontally elongated elements, each connected to the adjacent ones by hinges, composing in their whole a rolling shutter which slides on side guide bars. In order to attain a quick running movement, near the hinges located between the shutter elements there are provided, at both ends of the shutter elements, small rolling wheels which turn on horizontal pivots or axles and roll within the side guide bars. Each side guide bar has a vertical branch which defines the operative position of the section door when closed, a upper horizontal branch which defines a disappearance position of the section door when open, and a curved connection branch joining together said vertical and horizontal branches.

Some section doors are moved by a powered mechanism controlled by a key or a remote control, and this mechanism in general is irreversible or is hardly reversible, whereby it opposes by itself to any opening attempt not controlled by the motor. Therefore, the presence of other means suitable for blocking the door would not be unavoidable; nevertheless, in most cases such doors are also provided with a side latch intended for engaging, in its active position, in an opening provided in one of the side guide bars, and this latch may be manually operated or a handle lock may be provided for operating the latch. The provision of the latch may be bilateral. In any event, the provision of at least one latch, and often of a handle lock too, is needed in those cases in which the section door is not motor operated.

The section doors suffer a serious problem with reference to the latches. Usually, the latches are located in a more or less middle position along the height of an element of the section door, and they should have a very long stroke which comprises, in addition to the normal operating stroke of any latch with respect to the opening with which it should engage, by taking into account the lateral play foreseen for the elements, also the stroke needed for displacing the latch out of the thickness of the corresponding side guide bar. This is needed in order that the latch may go beyond the curved connection branch without interfering with the guide bar. As a consequence, the stroke needed for these latches may amount, in general, to about 50 millimeters, and it is very larger than the usual stroke of a latch, which is in general of about 25 millimeters; this is the stroke along which a latch is usually operated manually, and which can be easily operated by a lock handle.

Therefore, when the latch is operated manually, the user should take care of operating the latch along its entire, unusually long stroke because, if inadvertently he opens the latch only in part, then a clamping or even a serious damage of the section door takes place during the door opening. On the other hand if, as it often happens, the latch is operated by a handle lock, it is necessary to use a handle mechanism having features suitable to cover a long stroke, but such features are unusual for such mechanisms and, moreover, they are difficult to be embodied and are not of handy maneuver.

Operating such a long latch stroke through a limited rotation angle of a handle would be of difficult realization and, in any event, would require an excessive effort. The longer stroke could be obtained by imposing to the user a handle rotation more extended than the usual one of 90°, and this stroke should be obtained by rotating the handle in two subsequent times separated by a momentary abandonment of the handle. Such maneuver is uncomfortable, but in addition thereto it involves the danger that the user inadvertently omits the second part of the stroke whereby the latches, abandoned at a half of their stroke, come then to interfere with the guide bars in correspondence of the curved connection branches, thus causing the clamping or a serious damage of the section door.

An attempt has been made to make up for this dangerous disadvantage by submitting the handle to the action of a strong return spring, which impedes to abandon the handle in an intermediate position. However, in this case the maneuver of the handle should overcome, in addition to the resistance of the latch movement, the force of the spring, whereby the maneuver involves an excessive effort and is very uncomfortable.

Another disadvantage shown by the section doors is that it is very difficult to provide an automatic closure of the latches when the closure position is attained by the section door; this effect may be obtained only at the cost of serious constructive complications. However, this automatic closure would be very desirable for the users.

SUMMARY OF THE INVENTION

The present invention is situated in this context and its object is to remedy for all or a part of the disadvantages pointed out of the latches for section doors. In more detail, the main object of the invention is to provide an arrangement of the latch, thanks to that it is not needed to foresee for the latch a stroke longer than that usually needed for any latch whatever. According to a further development of the invention, an object is to make possible an automatic closure of the latch by using simple means. A particular object of the invention is to provide an operating set suitable for being installed onto a section door and comprising a latch according to the invention and, in case, also a hinge, wherein, if required, the latch may be operated by means of a handle lock of any commercial construction. Another object of the invention is to provide an assembly including a latch according to the invention and a handle lock for operating the same. A general object of the invention is to attain the stated objects without having recourse to complicated or costly arrangements and without requiring from the users any unusual maneuver.

The main object of the invention is attained, in a section door as above defined, which should be provided with a side latch intended to engage, in its active position, in an opening provided in one of the guide bars, by the fact that said side latch is located coaxially with one of said small wheels intended to roll within the side guide bars of the section door.

In this way, even when running across the curved connection branch of the guide bar, the latch always remains within the corresponding guide bar, and it cannot interfere therewith, whereby its operative displacement only requires the extension which is usually needed for any latch whatever, in order to engage the cooperating opening and disengaging therefrom, by taking into account the plays of the parts; and the latch does not require the additional extension needed for going off the guide bar thickness, as it happens for the latches according to the state of the art. As a consequence, the manual latch maneuver does not require a unusually long stroke, and, in the cases in which the latch is operated by a handle lock, the latch operating mechanism may be of any usual kind and it does not require neither a larger maneuver stroke nor the use of a strong return spring for the handle mechanism, and the consequent greater force needed for the maneuver.

It is also a subject of the invention a set including a latch as above defined and the small rolling wheel to which the latch is coaxial, wherein the small wheel is mounted on a hollow pivot or axle, and the latch is guided to slide within the bore of said hollow pivot or axle. As an alternative, the latch could form by itself the rotation axle for the small rolling wheel.

It is of advantage that the above defined set further includes a support member in which is mounted said hollow pivot or axle carrying the small rolling wheel and in whose cavity is guided and slides the latch, said support member having means for mounting the same, possibly in an adjustable position, on an element of the section door or one of its hinges.

The now defined set may further include a hinge intended to be fixed to two adjacent elements of the section door. Also, the set may include a partially cylindrical seat in which is mounted said hollow pivot or axle.

Advantageously, some position adjusting means are interposed between said support member and said partially cylindrical seat.

The latch according to the invention, possibly included in one of the above defined sets, may be provided with a means for its manual operation. Alternatively, the latch may be provided with a connection means intended to be connected to a handle lock for the actuation of the latch.

If required, this connection member may extend in a direction perpendicular to the latch in order to allow a displacement of the axes between the latch and a member through which the lock transmits the operation to the latch. In this way, when needed, the handle lock may be installed on an element of the section door in the position that appears to be aesthetically and practically more convenient, this position being not bound to the position of the lock, which should be coaxial with a small running wheel and, therefore, is necessarily located near a hinge between two elements of the section door.

According to a further development of the invention, the latch is provided with a spring so arranged as to transmit to the latch, in an elastically yielding manner, a force directed towards the closure position, whereby it allows an automatic closure of the latch when the section door attains its closure position. In this way, the closure of the latch may be prearranged at any time, and thereafter the latch simply slides against the corresponding guide bar, under action of the spring, until the closure position of the section door is attained. Then the latch finds its corresponding opening and engages the same, thus operating the automatic closure. Such an arrangement can be adopted both for a manually operated latch and for a latch operated by a handle lock.

BRIEF DESCRIPTION OF THE DRAWINGS

These and other features, objects and advantages of the subject of the present invention will appear more clearly from the following description of some embodiments, to be considered as non limiting examples, with reference to the appended drawings, wherein:

FIG. 3 diagrammatically illustrates in profile a portion of a section door, including the curved connection branch of a guide bar.

FIG. 4 diagrammatically shows the cross section of a guide bar, wherein a small running wheel is engaged.

FIG. 5 shows in profile an adjustable support member being a part of the assembly of FIG. 1.

FIG. 6 shows in perspective, isolated, the latch being a part of the assembly of FIG. 1.

DESCRIPTION OF THE PREFERRED EMBODIMENTS

Figure 1:
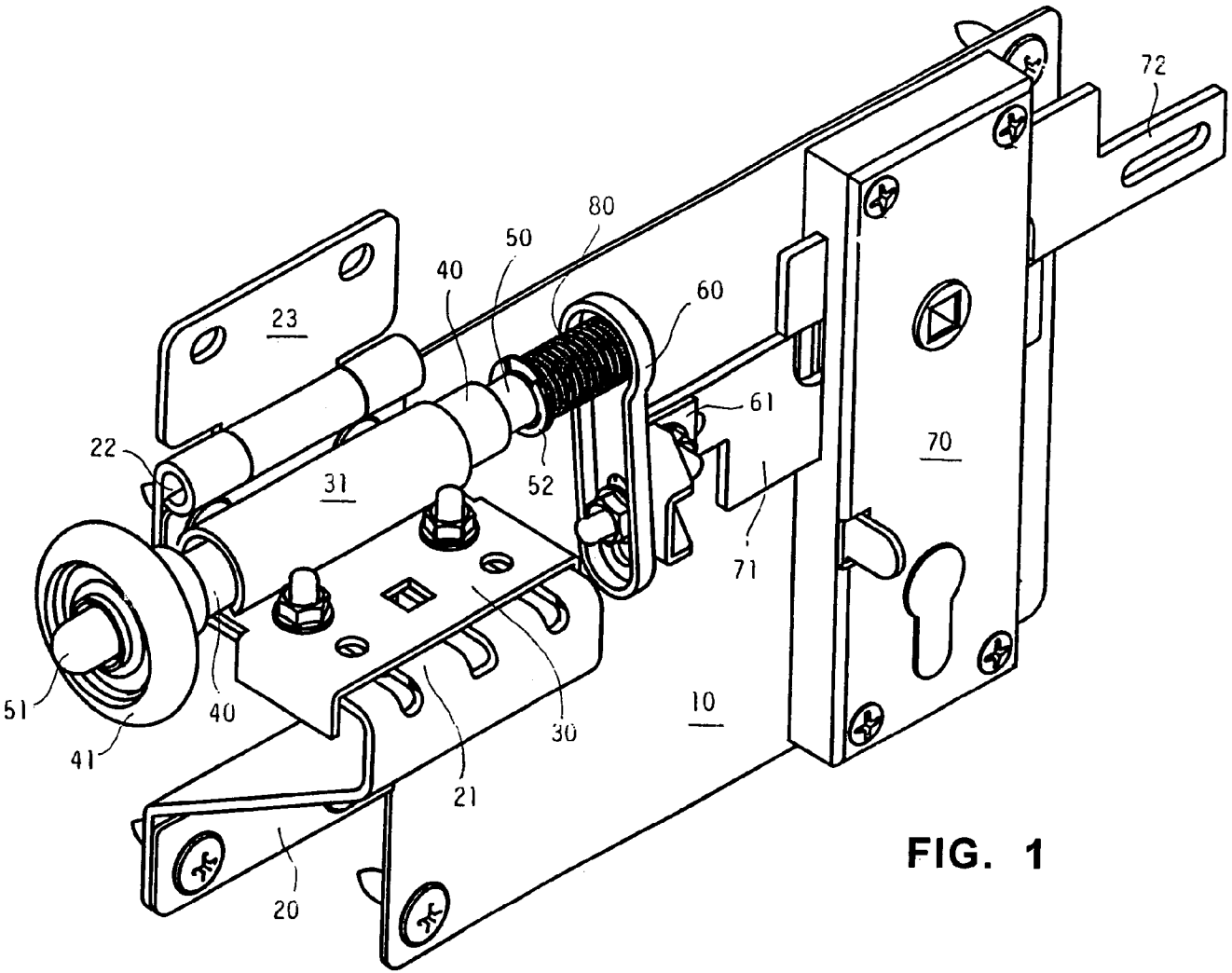
FIG. 1 shows in perspective the whole assembly of a latch, its fittings and a handle lock for a section door, according to the invention, in a first embodiment.

With reference to FIG. 3, in the following will be clarified the main problem, already mentioned in the preamble, that is noticed in the section doors with respect to the latch. A section door, of which only a portion is diagrammatically represented in profile in FIG. 3, comprises two side guide bars, only one of which is shown and includes a vertical branch G1, defining the operative position of the section door when closed, a upper horizontal branch G2, defining a disappearance position of the section door when open, and a curved connection branch G3, located between said vertical branch G1 and said upper horizontal branch G2. A number of section door elements E1, E2, E3, E4 are mutually connected by means of hinges C1, C2, C3, and they are provided at their end portions, near the hinges, with small running wheels R1, R2, R3 engaged in the side guide bars. The shape in cross section of a guide bar G1 and the engagement therein of a small running wheel R1 are diagrammatically shown in FIG. 4.

Suppose that, according to the state of art, an element as E2 of the section door is provided in its middle region with a side latch K2, whose end portion is located inside the guide bar and is intended to engage, in its operative position, in a corresponding opening O provided in the vertical branch G1 of the guide bar. When the element E2 during the opening operation of the section door runs across the connection branch G3 of the guide bar, taking the position E3, its latch takes the position K3, which is located outside the guide bar. Should the latch having been retracted only the amount needed for disengaging from the corresponding opening, the end portion thereof would still lie inside the guide bar and, during the said displacement, would interfere with the wall of the guide bar G3. Therefore the latch has to be additionally retracted at least of an amount S (FIG. 4) corresponding to the thickness of the guide bar. This is the reason for which the latch, according to the state of art, requires a large displacement length, and from the need of this large displacement result the drawbacks pointed out in the preamble.

It is to be remarked that the same phenomenon occurs in the case that the latch is installed in a position as K2' (not shown), namely outside the guide bar G1 at the side opposite the center of the curved branch G3. On the contrary, this phenomenon does not occur if the latch is installed in a position such as K2Δ (not shown), namely outside the guide bar G1 at the same side of the center of the curved branch G3. However, this installation position is unfavorable for several technical, economical and aesthetical reasons.

Moreover it is to be remarked that, because in order to allow the displacements for opening and closing the section door the latch should be always kept out of any possible interference with the guide bar, it is not possible to foresee for the latch, except by having recourse to complicated mechanisms, an automatic closure when the section door attains its closure position.

On the contrary it is evident that, because the small running wheels as R2 always remain inside the guide bar, a latch as K4, mounted according to the invention coaxial with a small running wheel as R2, will in no event interfere with the walls of the guide bar, and therefore it does not require to be retracted of the additional amount S, but only of that length which is required by any latch for disengaging from the corresponding engagement opening and for taking into account the plays of the parts. Therefrom also result the possibility, which will be described later on, of providing with very simple means an automatic closure of the latch when the section door closes.

The whole assembly of a latch with a handle lock for a section door, according to the invention, in the embodiment depicted in FIG. 1, comprises a base plate 10, intended to be fixed on the inner face of an element G2 (FIG. 2) of the section door, and an operative set mounted on an adjustable support member 20 intended to be fixed on the inner face of the same element G2 of the section door as well as to the upper immediately adjacent element G3. The adjustable support member 20 is shown as separate from the base plate 10, but both parts could also be embodied, at least in part, as a single piece. The base plate 10 may also be omitted when the various component parts are mounted directly and separately on the section door elements, however its presence allows ensuring without difficulties that the various component parts are mounted on the section door in correct mutual positions.

The adjustable support member 20 intended to be fixed to the element G2 of the section door forms a bracket 21 and it terminates at the upper end with a hinge 22, whose movable part 23 is intended to be connected to the overlying element G3 of the section door. On the bracket 21 is fixed, in this case in an adjustable position, the base portion 30 of a cylindrical seat 31, wherein there is seated the hollow pivot or axle 40 of a small running wheel 41. The small running wheel 41 may be solid with the hollow pivot 40 which, in this case, should be rotatable in the cylindrical seat 31 which acts as a bearing, or even, and preferably, the small running wheel 41 is rotatably mounted by means of a bearing on the hollow axle 40, which then may be operatively fixed within the cylindrical seat 31 and, if needed, may be adjustable in its longitudinal position.

Inside the cavity of the hollow pivot or axle 40 there is inserted a longitudinally sliding latch 50, whose distal end portion 51 is suitable for protruding with respect to the small running wheel 41. At its proximal end portion, the latch 50 has in this embodiment a connection member 60 intended to be connected to a handle lock. In this embodiment, said connection member 60 extends in a direction perpendicular to latch 50, in order to allow a displacement of axes between the latch 50 and the operating member through which the handle lock transmits the movement to latch 50. This allows to freely choose the position in which the handle lock is fixed to element G2 of the section door. However, in those cases in which the handle lock has its operating member located in alignment with latch 50, the connection member 60 may not extend in a direction perpendicular to latch 50, and in certain cases it may also be omitted.

The handle lock, designated in its whole by number 70, is mounted on the base plate 10 (or even directly on element G2 of the section door) and it has an operating member 71 intended to be connected to the connection member 60, preferably through an adjustable joint 61 of the connection member 60. The handle lock 70 may, if needed, have a second operating member 72, opposite the operating member 71, in order to operate a second latch (not shown) acting at the opposite end of element G2 of the section door. In any event, the second operating member 72 may be present even if not required, when use is made (as it is possible thanks to the application of the invention) of a commercial handle lock, not especially designed and manufactured for being applied on a section door.

For the already clarified reasons, latch 50 does not require to be operated on a length larger than the normal operation length of any latch whatever. As a consequence, the handle lock 70 may be of any known kind, it may be commercial or, even when it is especially manufactured for the application of the invention, it does not require design, construction or maneuver features different from those of a common handle lock.

As according to the state of art, the handle lock 70 may positively operate both the advancement and the retraction of latch 50. However, the application of the invention allows easily providing an automatic engagement of the latch, prearranged at a preceding time by the handle lock.

In this case, as shown for the presently discussed embodiment, the connection member 60 is slidably mounted with respect to the proximal end portion of latch 50, and between this connection member 60 and a stop 52 carried by the latch there is inserted a compression spring 80. Stop 52 may be formed by an elastic ring inserted in a groove of latch 50. Similarly, an elastic ring 53 limits the stroke of the connection member 60 by avoiding its escape from the proximal end of latch 50.

Thanks to this arrangement, the handle lock can prearrange the latch closure in any moment, when the latch is not in correspondence with the engagement opening of the guide bar, and the closure order for the latch, emitted by the handle lock, is transformed by spring 80 in an elastic stress applied to latch 50, whose distal end portion 51 is thus elastically pushed against the corresponding guide bar. The end portion 51 slides therefore against the web of the guide bar during the displacement of the section door and, when the section door attains its closure position, it finds itself in front of the corresponding engagement opening and it elastically springs therein, thus blocking the section door in its closure position.

In this case, in order to facilitate the sliding of the distal end portion 51 of latch 50 against the web of the guide bar, this end portion may preferably be rounded as it has been represented. However, it is also possible to furnish the distal end 51 of latch 50 with a small wheel or ball, intended to roll against the web of the guide bar.

The hollow pivot or axle 40, the small running wheel 41, the latch 50 extending in the cavity of the hollow pivot or axle 40, the adjustable support member 20 for these parts, the hinge 22–23 and possibly the connection member 60 annexed to latch 50, form a first operating set. This first set may be supplied to the manufacturers of section doors as the sole element for the application of the invention, being intended to cooperate with a handle lock of any kind and of any different provenance. This first set can also be deprived of a hinge, when it is preferred to use a hinge separate therefrom.

The characteristic component part of this first set consists of the adjustable base 30 which carries the cylindrical seat 31, the hollow pivot or axle 40 with a small running wheel 41, and the latch 50 extending in the cavity of the hollow pivot or axle 40. Therefore, these component parts form a second set which may be supplied to the manufacturers of section doors as the sole element for the application of the invention, being intended to be applied on the bracket 21 of a support member 20 with hinge 22, of a known type and possibly of a different provenance, or even on a support member separate from the hinge.

When the latch according to the invention has to be controlled by a handle lock, various types of locks may be used, and different arrangements may be used for connecting the latch to the operating member of the lock, as shown for example by FIGS. 7 to 11.

Figure 2:
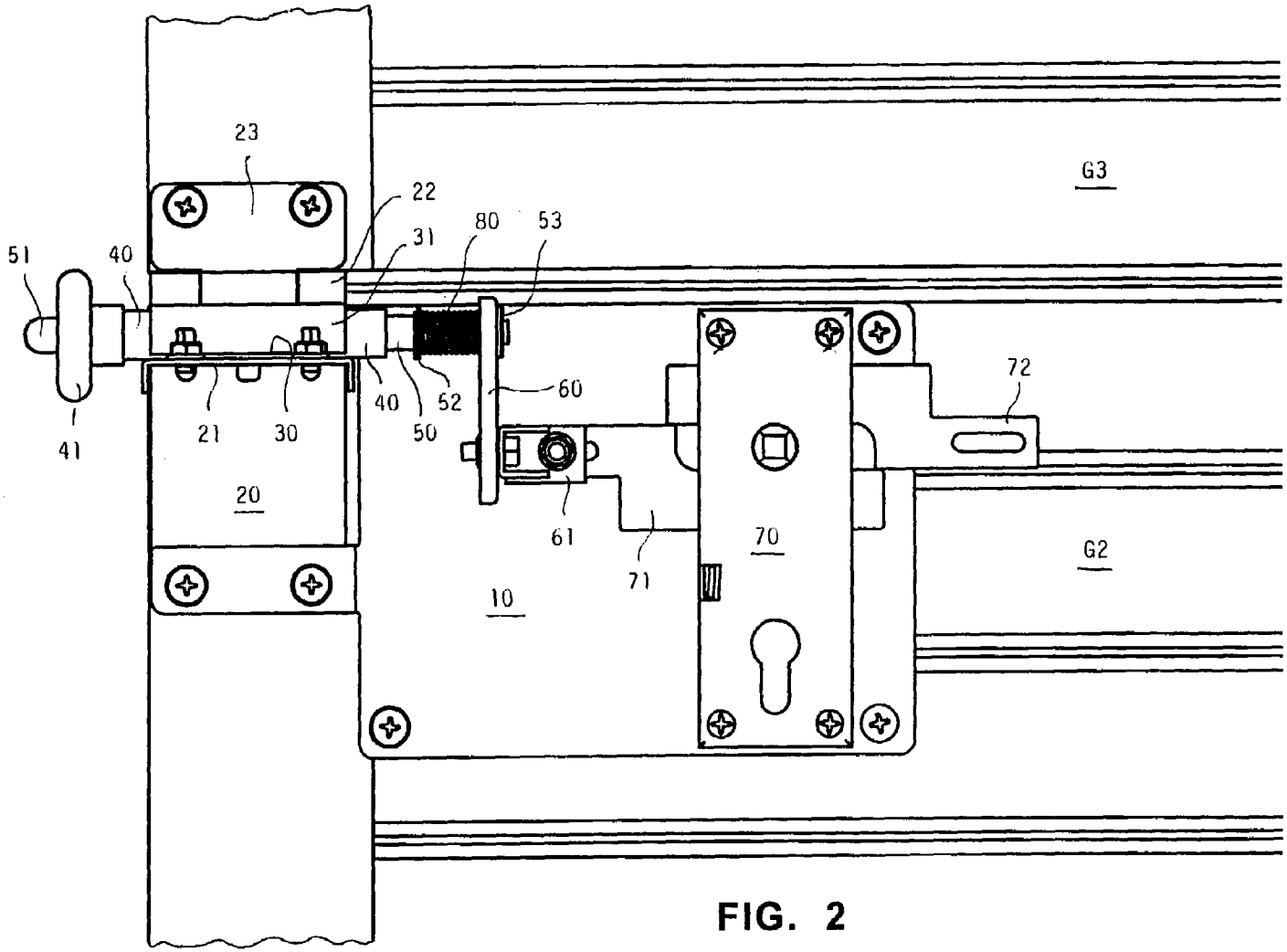
FIG. 2 shows in front view the assembly according to FIG. 1, mounted on a section door, this latter being only partially shown.
Figure 7:
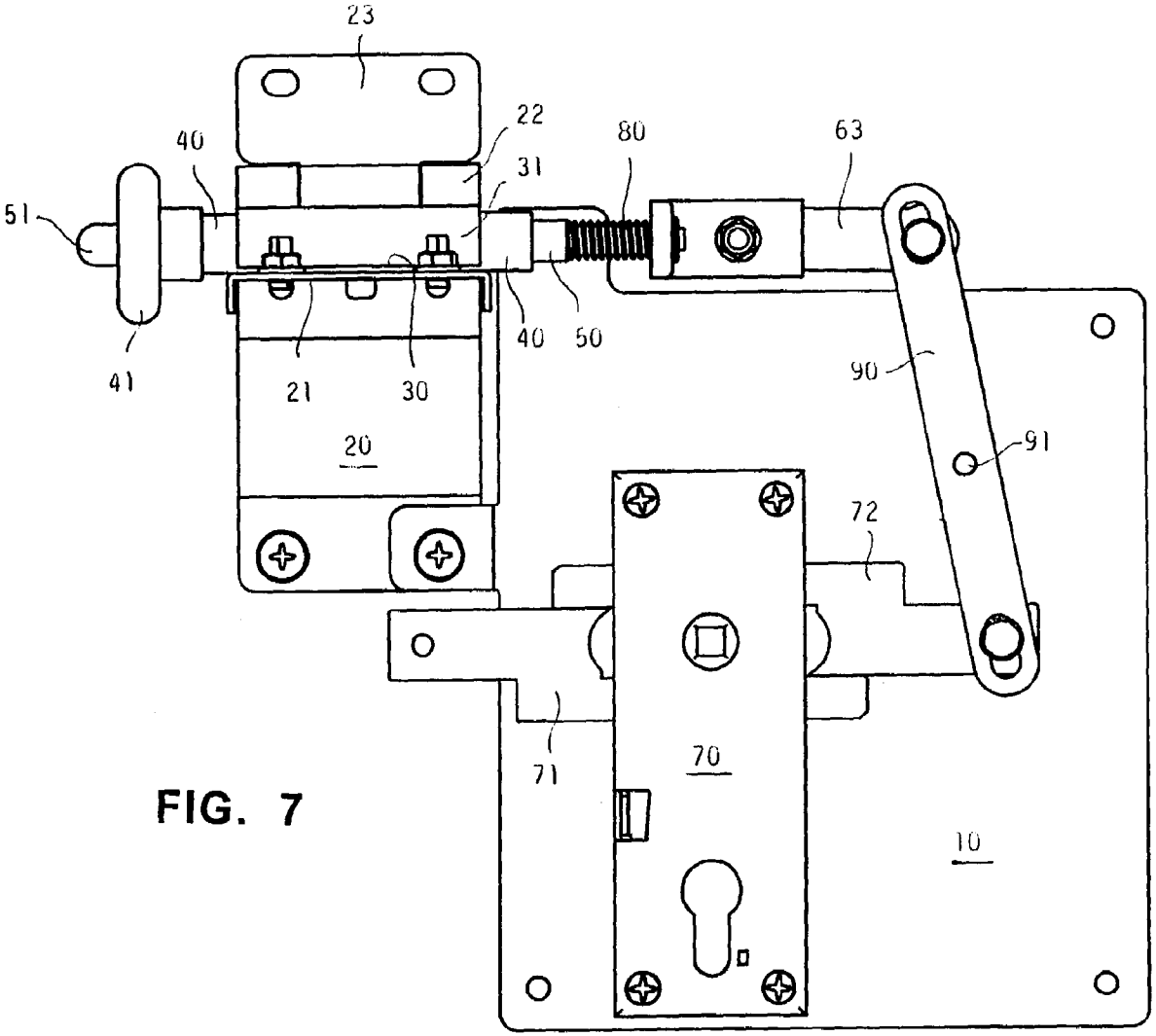
FIGS. 7 to 12 illustrate other embodiments of the invention.

According to FIG. 7, the lock 70 is of the same type shown in FIGS. 1 and 2, but the connection between a connection member 63 of the latch 50 and the operating member 72 of lock 70 is done by means of a two-beams lever 90, which is pivoted at 91 to the base plate 10. This arrangement also allows, when needed, to mutually proportion the operative strokes of latch 50 and of the operating member 72 of lock 70, by suitably choosing the ratio between the two beams of lever 90.

Figure 8:
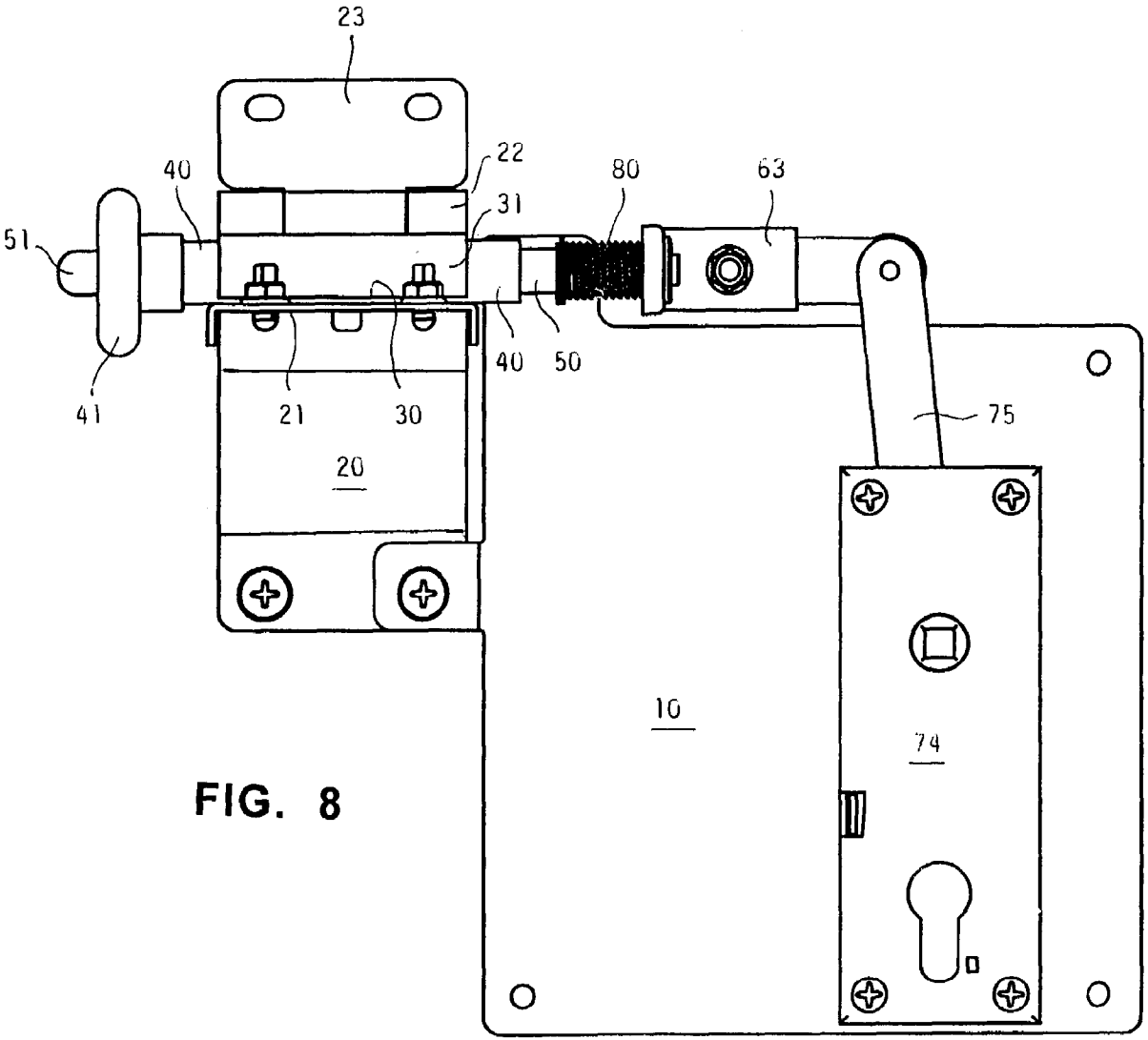

According to FIG. 8, use is made of a lock 74 whose operating member 75 has an oscillating movement instead of a translation movement. In this case, the operating member 75 of lock 74 may be directly connected to the connection member 63 of latch 50.

Figure 9:
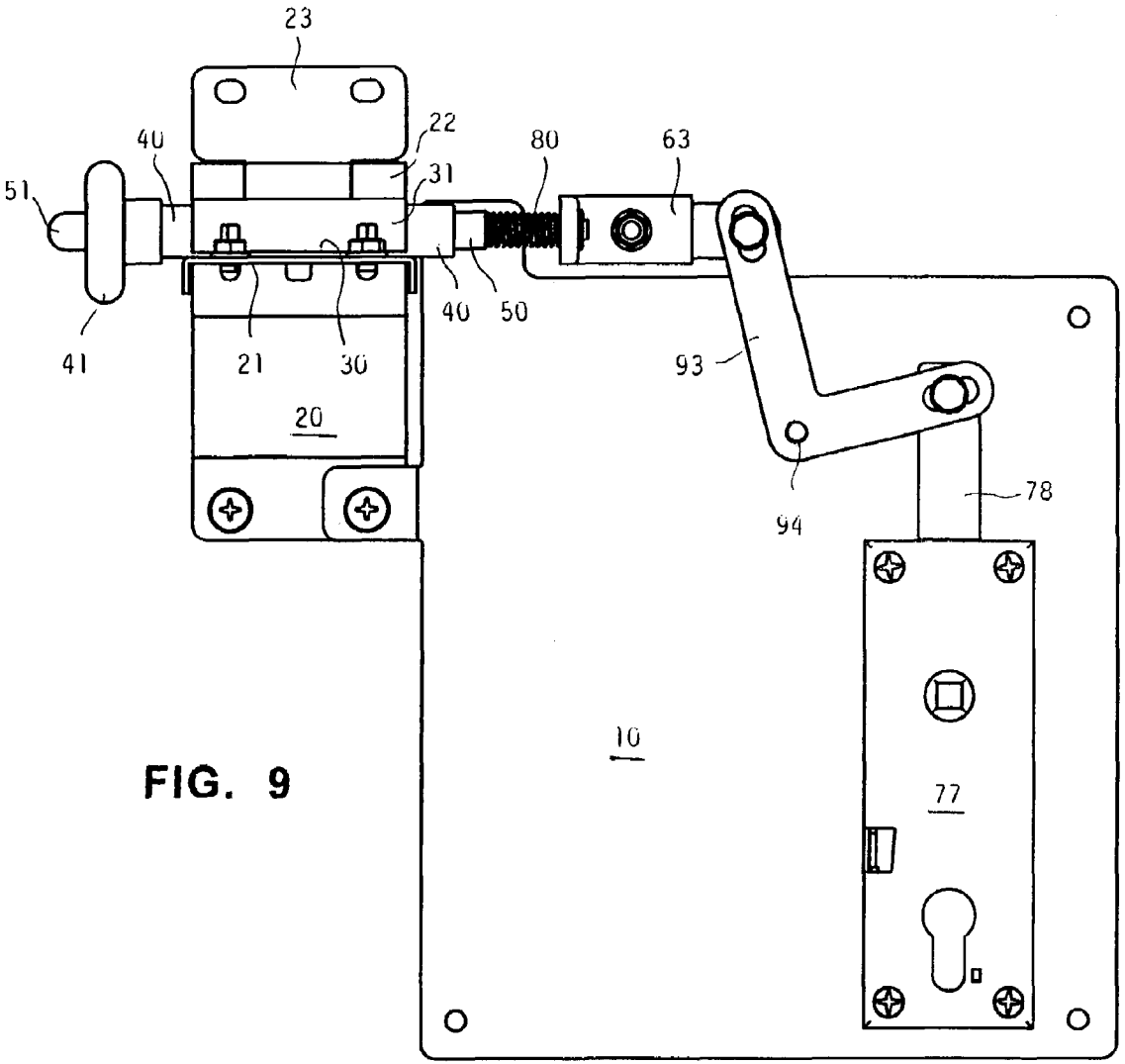

According to FIG. 9, use is made of a lock 77 whose operating member 78 displaces along a longitudinal direction (vertical according to the drawing), rather than according to a transversal direction, with respect to lock 77. In this case, the operating member 78 of lock 77 can be connected to the connection member 63 of latch 50 by means of an angular two-beam lever 93, which is pivoted at 94 to the base plate 10. As in the case of FIG. 7, this arrangement allows, when needed, to mutually proportion the operative strokes of latch 50 and of the operating member 78 of lock 77, by suitably choosing the ratio between the two beams of the angular lever 93.

Figure 10:
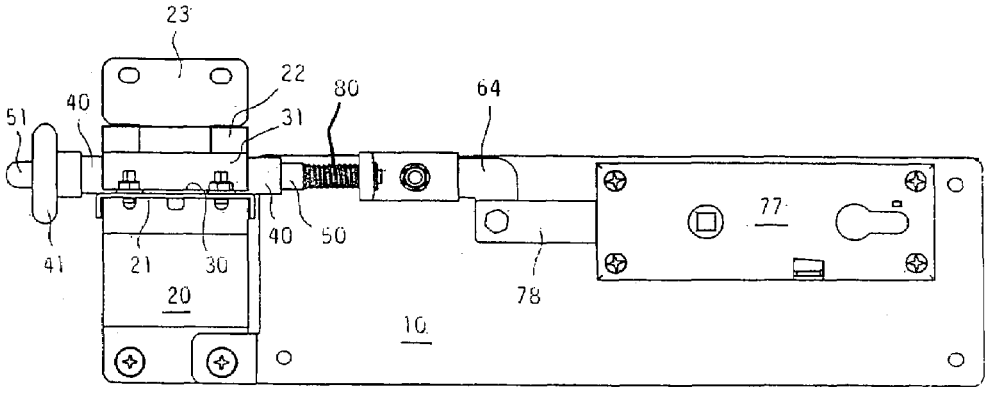

According to FIG. 10, a lock 77 of the same kind used according to FIG. 9 may be oriented in such a way, that its operating member 78 displaces in the same direction of latch 50, namely horizontal according to the drawing. In this case, the operating member 78 of lock 77 may be directly connected to the connection member 63 of latch 50.

Figure 11:
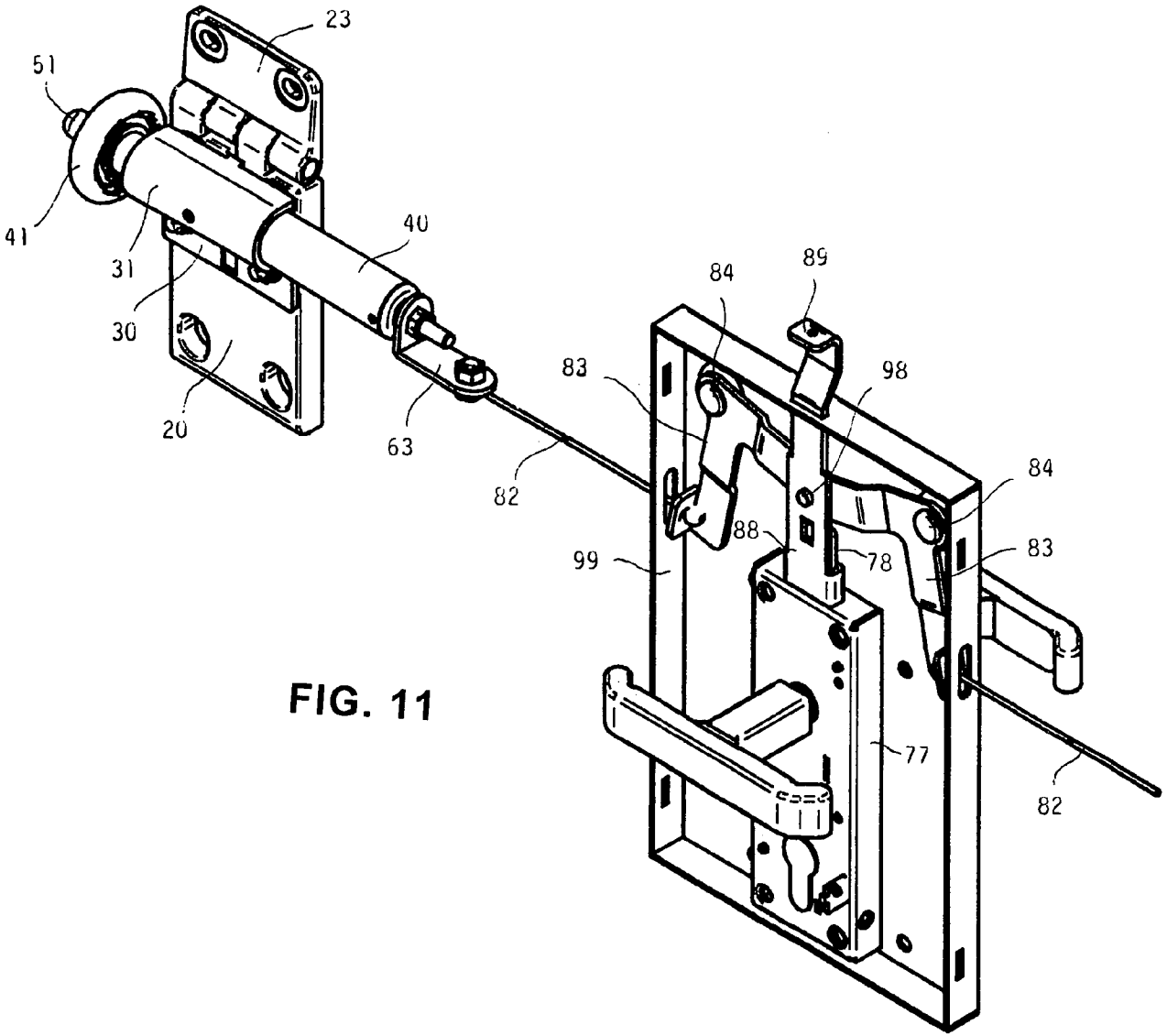

In FIG. 11 there is represented a particular application of a lock as that according to FIG. 9, inserted in an lock device intended to operate a latch according to the invention. This lock device is enclosed in a box 99, which is represented deprived of a cover plate which, in use, covers the mechanisms. Lock 77 has an operating member 78 which displaces along the longitudinal direction of lock 77, namely in vertical direction according to the drawing. With this operating member 78 is slidingly coupled a rod 88, which projects at top with a portion 89 from the box 99 and carries a pivot 98. To this pivot 98 are articulated angular two-beams levers 83 pivoted at 84 to box 99. These levers have the same transmission function of the angular two-beam 93 according to FIG. 9. They are connected to the connection member 63 of latch by means of a flexible metallic cable 82. There is shown also a second cable 82 which is intended to operate another latch (not represented) located at the opposite side of the section door.

With the represented mechanism, when the operating member 78 of lock 77 is displaced upwards, it acts against pivot 98 and, through the angular two-beam levers 83, it exerts a traction on cables 82 and therefore on the connection members 63 of the latches and displaces the same in the open position. On the contrary, until the operating member 78 of the lock remains in its lower position, no traction is exerted on cables 82, which can weaken thus allowing the latch springs to pull the latches in their closure positions, or to elastically stress the same for a subsequent automatic closure, as it has been described. The latch spring, in this example, is shown as concealed, protected and backed by an extension of the hollow axle 40 or by a corresponding small tube.

The portion 89 of rod 88 may be connected by means of a cable (not represented) to a motor mechanism in such a way that the latches are displaced in their open position when the motor mechanism has to open the section door, without requiring that the user opens beforehand the lock 77.

FIG. 11 also shows that, in those cases in which an adjustment of the position of latch 50 is not required, the bracket portion 21 of the support member 20 according to FIG. 1 can be omitted, and this support member may be reduced to a plate, directly supporting a partially cylindrical seat 31 wherein the hollow axle 40 of the small wheel 41 is seated, and to which the hinge portion 23 is articulated. In this way a reduction of the cost of the device is obtained.

Figure 12:
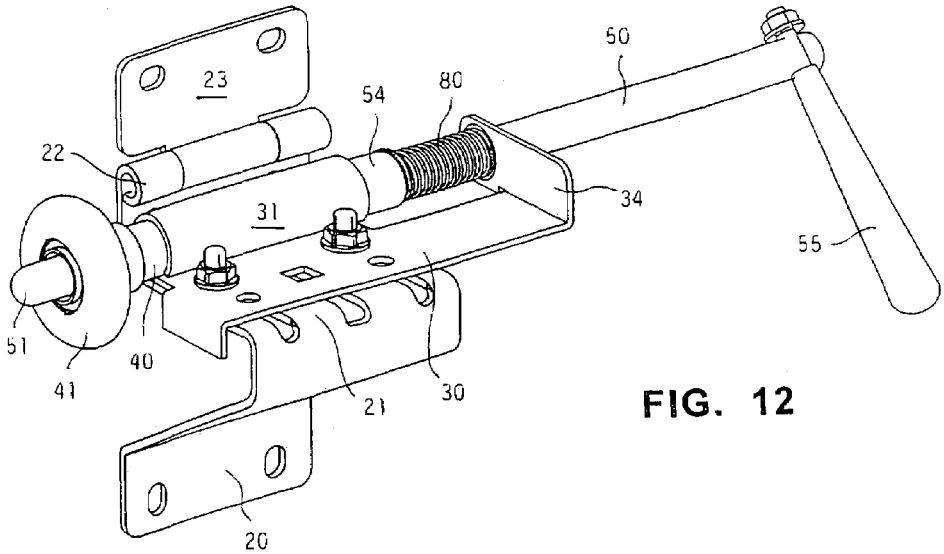

Finally, FIG. 12 shows as the latch 50 may be arranged for its manual operation, by providing the same with a handle 55 or other manual maneuver means. Even in this case it is possible to provide the automatic closure of the latch by inserting a spring 80 between a shoulder 54 of latch 50 and a squared stop 34 of the adjustable support member 30.

It is to be understood that the invention is not limited to the embodiments described and illustrated by way of examples. Several possible changes have been stated in the course of the description, and others are within the reach of those skilled in the art. These changes and others, and any replacement by technically equivalent means, may be made to what has been described and illustrated, without departing from the spirit of the invention as defined by the appended claims.

What is claimed is:

1. A section door latch assembly for closing a section door, said section door including a plurality of horizontal elongated elements; hinges mutually connecting said elements; side guide bars for sliding engagement of said section door, one of said side guide bars having an opening; small rolling wheels sliding within said side guide bars, each one of said side guide bars having a vertical branch which defines the operative position of the section door when closed, an upper horizontal branch which defines a disappearance position of the section door when open, and a curved connection branch joining together said vertical and horizontal branches;

wherein said latch assembly is displaceable between an inactive position and an active position, and is intended for engaging, in said active position, in said opening provided in said one of said side guide bars;

wherein said latch assembly comprises:

a latch;

a hollow pivot or axle having a bore, said one of said small rolling wheels being mounted on said hollow pivot or axle and coaxial to said latch, said latch being guided to slide within the bore of said hollow pivot or axle; and a support member having means for adjustably mounting the support member on one of said elongate elements or one of said hinges, and including a partially cylindrical seat in which said hollow pivot or axle is mounted.

2. The latch assembly according to claim 1, further comprising a hinge intended to be fixed to an adjacent two of said plurality of elements.

3. The latch assembly according to claim 1, wherein said support member further comprises a position adjusting means interposed between said support member and said cylindrical seat.

4. The latch assembly according to claim 1, wherein said support member further comprises a bracket.

5. The latch assembly according to claim 1, wherein said support member is substantially plate shaped.

6. The latch assembly according to claim 1, wherein said latch further comprises a means for the manual operation thereof.

7. The latch assembly according to claim 1, wherein said latch further comprises a connection member intended to be connected to a handle lock for the actuation of the latch.

8. The latch assembly according to claim 1, wherein said latch further comprises a connection member intended to be connected to a handle lock for the actuation of the latch, wherein said connection member extends in a direction perpendicular to the latch in order to allow a displacement of the axes between the latch and a member of the lock operating the latch.

9. The latch assembly according to claim 1, further comprising a spring so arranged as to transmit to the latch, in an elastically yielding manner, a force directed towards said active position, whereby the spring allows an automatic closure of the latch when the section door is in said closure position.

10. The latch assembly according to claim 1, further comprising a handle lock connected to said latch.

11. The latch assembly according to claim 1, further comprising a connection member of the latch and a handle lock having an operating member directly connected to said connection member of the latch.

12. The latch assembly according to claim 1, further comprising a connection member of the latch, a handle lock having an operating member, and a two-beam lever connected to said connection member of the latch and to said handle lock.

13. The latch assembly according to claim 1, further comprising a connection member of the latch, a handle lock device and a flexible metallic cable connected to said handle lock device and to said connection member of the latch.

14. The latch assembly according to claim 1, wherein a distal end portion of said latch is intended to run against a web of the guide bar, wherein, in order to facilitate the run of the distal end portion of the latch, said end portion is rounded or includes a small wheel or ball arranged for running against the guide bar web.

15. The latch assembly according to claim 1, further comprising a lock device, said lock device comprising a handle lock, an operating member, a rod slidably coupled with said operating member, at least one angular two-beam lever articulated to said rod and connected to said latch, and means arranged for transmitting to said rod only in one direction the displacements of said operating member, said rod being available for the motorized actuation of the latch.

16. A latch assembly comprising:

a support member having a partially cylindrical seat;

a hollow axle within said cylindrical seat;

a latch slidable within said hollow axle;

a rolling wheel rotatably mounted on said hollow axle and coaxial with said latch, said latch being displaceable between an inactive position and an active position and being engageable in said active position in an opening provided in a guide bar of a section door.

* * * * *